United States Patent [19]

Annett

[11] 4,086,740

[45] May 2, 1978

[54] BLOCKS OF REFRACTORY CONCRETE

[75] Inventor: Keith Annett, Birmingham, England

[73] Assignee: Foseco Trading A.G., Switzerland

[21] Appl. No.: 731,143

[22] Filed: Oct. 12, 1976

[30] Foreign Application Priority Data

Oct. 10, 1975 United Kingdom ..... 41688/75

[51] Int. Cl.[2] ..... E04B 1/38

[52] U.S. Cl. ..... 52/511; 53/606; 110/336

[58] Field of Search ..... 52/606, 512, 506, 513, 52/378, 379, 127, 508, 511; 110/1 A, 1 B

[56] References Cited

U.S. PATENT DOCUMENTS

| | | | |
|---|---|---|---|
| 1,616,746 | 2/1927 | Gutridge | 52/513 |
| 2,021,610 | 11/1935 | Quint | 110/1 A |
| 2,341,777 | 2/1944 | Hensel | 52/378 X |

FOREIGN PATENT DOCUMENTS

| | | | |
|---|---|---|---|
| 311,593 | 5/1929 | United Kingdom | 110/1 A |

*Primary Examiner*—Ernest R. Purser
*Assistant Examiner*—Carl D. Friedman
*Attorney, Agent, or Firm*—Caesar, Rivise, Bernstein & Cohen, Ltd.

[57] ABSTRACT

Refractory concrete blocks e.g. furnace wall lining blocks, have a through hole for attachment of the block to a support by a bolt. The hole has a narrow portion next the support and a wider portion more remote therefrom having a keying configuration so refractory paste inserted after installation to protect the bolt head does not drop out in use.

1 Claim, 2 Drawing Figures

BLOCKS OF REFRACTORY CONCRETE

This invention relates to blocks of refractory concrete.

Blocks of refractory concrete are used in plant in many industries, including the metallurgical and glass-making industries, the power generation industry and in petrochemical and refuse incineration plant. The size and shape of such blocks may vary widely. Examples of specific types of block are furnace lining blocks, dome blocks, burner quarls, baffle tiles, tuyere linings and door blocks.

Such blocks usually have holes in them through which threaded bolts are passed to hold the block to a support. Often the hole has a narrow and a wide portion so that a nut and washer or bolt head may abut a shoulder within the thickness of the block and not project from its surface. After the block has been fixed in position the rest of the wide portion is filled with a refractory paste, mortar or the like to protect the bolt from the effects of elevated temperatures. This system however has disadvantages: it is difficult to ensure that the set paste stays in position; without hard ramming the paste or mortar tends to fall out of the hole in use; on the other hand, if the paste, mortar or the like is firmly set it cannot readily be removed if access to the bolt is ever required.

According to the present invention there is provided a block of refractory concrete, the block having at least one through hole for reception of a bolt by which the block may be secured to a support, the hole having a relatively narrow diameter portion opening at one face, and a relatively major diameter portion at the opposite face, in which the major diameter portion has a keying configuration. Such a keying configuration may be effected e.g. by forming the major diameter portion with a relatively enlarged portion at or near where it joins the minor diameter portion. The enlarged portion may be an annular groove or the wall of the major diameter portion may be conical, its narrower end at the face of the block. In use of the block, such a keying configuration stops the refractory paste falling out.

Figure 1:
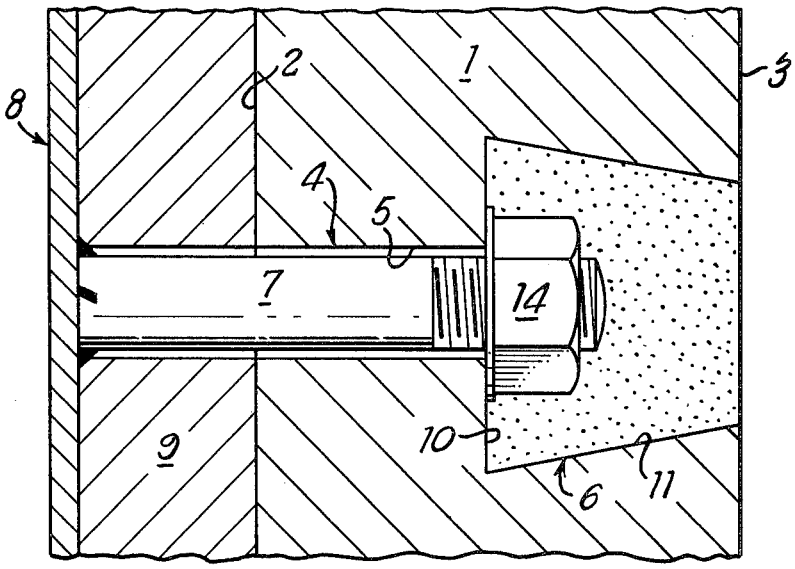
Figure 2:
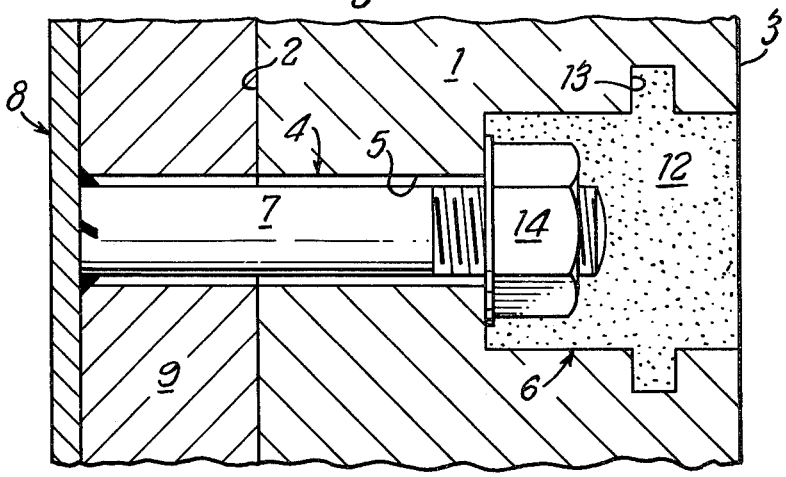

Two embodiments of the invention will be described with reference to the accompanying diagrammatic drawings, in which FIG. 1 is a cross-sectional view of part of a block according to the invention installed in a furnace, and FIG. 2 is a cross-section of an alternative embodiment.

The same reference numerals denote like parts in both Figures. Referring to the drawings, a refractory concrete block 1 is substantially the shape of a rectangular parallelepiped and has opposite back and front faces 2 and 3. Face 3 constitutes part of the wall of the furnace chamber. A through hole 4 extends from the back face 2 to the front face 3 and comprises a relatively narrow diameter portion 5 adjacent the back face and relatively wider diameter portion 6. The narrow diameter portion 5 is slightly larger than the diameter of a stud 7 which is welded to a back plate 8 forming part of the wall of a furnace. Block 1, together with an intermediate refractory layer 9, between plate 8 and block 1, is supported on stud 7 and held thereon by a nut 14. The major diameter portion 6 comprises a back wall 10 and has a tapering sidewall 11 which narrows towards the front face 2.

The block of FIG. 2 is the same as that of FIG. 1 except the major diameter portion 6 has a straight sided wall 12 having an annular groove 13.

The blocks may be made by casting a refractory concrete in a mould, a plastics core being located in the mould to define the desired shape of the through hole 4. After the block has been cast, the core may be removed from the hole by dissolving the plastics using a suitable solvent.

In use, the block 1 is assembled on stud 7 and anchored by threading nut 14 on to the threaded end of the stud 7. The cavity of the major diameter portion 6 is then filled with a refractory concrete paste which is keyed into that portion either by the taper of the wall 11 (FIG. 1) or by reason of the groove 13 (FIG. 2) without the need for heavy ramming or the risk that the set material will be released. If access to the nut is needed, the set paste can be removed with relative ease.

I claim:

1. In combination a block of refractory concrete having at least one through hole and a bolt having a nut thereon and by which the block is secured to a support, said hole having a relatively narrow diameter portion opening at one face and through which said bolt extends and a relatively major diameter portion opening at the opposite face and in which said nut is located, with the interface of said narrow and major diameter portions forming a back wall upon which said nut is disposed, said major diameter portion having a keying configuration in the form a continuous ring-like groove in the wall thereof, said major diameter portion being filled with a refractory concrete paste.

* * * * *